US008294375B2

(12) United States Patent
Lee

(10) Patent No.: US 8,294,375 B2
(45) Date of Patent: Oct. 23, 2012

(54) ADAPTIVE PWM CONTROLLER FOR MULTI-PHASE LED DRIVER

(75) Inventor: Ki-Chan Lee, Cupertino, CA (US)

(73) Assignee: Intersil Americas Inc, Milpitas, CA (US)

( * ) Notice: Subject to any disclaimer, the term of this patent is extended or adjusted under 35 U.S.C. 154(b) by 398 days.

(21) Appl. No.: 12/705,783

(22) Filed: Feb. 15, 2010

(65) Prior Publication Data

US 2011/0084620 A1 Apr. 14, 2011

Related U.S. Application Data

(60) Provisional application No. 61/243,635, filed on Oct. 8, 2009.

(51) Int. Cl.
*H05B 37/02* (2006.01)

(52) U.S. Cl. ..... 315/186; 315/185 R; 315/291; 315/294; 315/307; 315/308; 345/101; 345/102; 345/211; 345/212

(58) Field of Classification Search ..... 315/185 R, 315/186, 193, 209 R, 247, 291, 294, 307, 315/308; 345/102, 101, 211, 212
See application file for complete search history.

(56) References Cited

U.S. PATENT DOCUMENTS

| | | | | |
|---|---|---|---|---|
| 7,312,783 | B2 * | 12/2007 | Oyama | 345/102 |
| 2006/0186830 | A1 * | 8/2006 | Shami et al. | 315/291 |
| 2008/0054815 | A1 * | 3/2008 | Kotikalapoodi et al. | 315/192 |
| 2009/0140665 | A1 * | 6/2009 | Park | 315/291 |
| 2009/0262057 | A1 * | 10/2009 | Yoon et al. | 345/89 |
| 2009/0289559 | A1 * | 11/2009 | Tanaka et al. | 315/185 R |
| 2010/0013412 | A1 * | 1/2010 | Archibald et al. | 315/294 |

* cited by examiner

*Primary Examiner* — Douglas W Owens
*Assistant Examiner* — Thai Pham
(74) *Attorney, Agent, or Firm* — Howison & Arnott, L.L.P.

(57) ABSTRACT

A multi channel LED driver comprises a plurality of LED strings. Each of the plurality of LED strings are associated with a separate channel. A voltage regulator generates an output voltage to the plurality of LED strings responsive to an input voltage and a PWM control signal. First control logic generates the PWM control signal responsive to a voltage at a bottom of each of the plurality of LED strings. A plurality of dimming circuitries, each connected to one of the bottoms of the plurality of LED strings, control a light intensity in each of the plurality of LED strings responsive to dimming control signals. Second control logic generates the dimming control signals responsive to forward currents monitored through each of the plurality of LED strings and dimming data.

15 Claims, 4 Drawing Sheets

ADAPTIVE PWM CONTROLLER FOR MULTI-PHASE LED DRIVER

CROSS-REFERENCE TO RELATED APPLICATIONS

This application claims priority from U.S. Provisional Application No. 61/243,635, filed Oct. 8, 2009, entitled ADAPTIVE PWM CONTROL AT MULTI-CHANNEL LED DRIVER IC, all of which is incorporated herein

BRIEF DESCRIPTION OF THE DRAWINGS

For a more complete understanding, reference is now made to the following description taken in conjunction with the accompanying Drawings in which.

DETAILED DESCRIPTION

Figure 1:
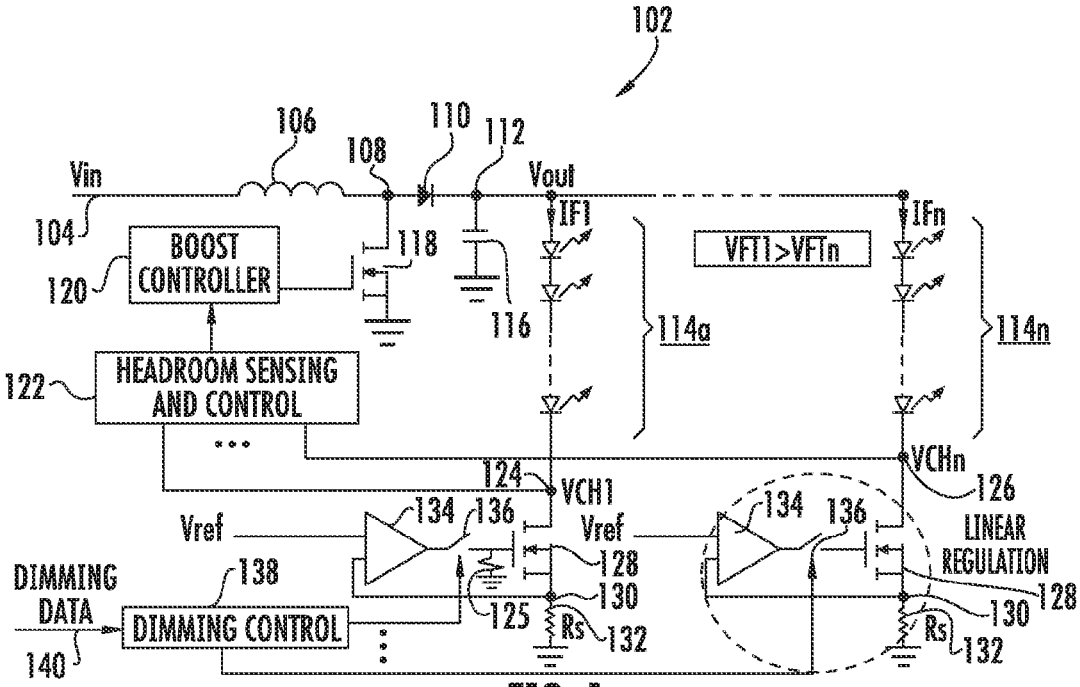
FIG. 1 PRIOR ART
FIG. 1 is a schematic diagram of a conventional multi-channel LED driver.

Referring now to the drawings, wherein like reference numbers are used herein to designate like elements throughout, the various views and embodiments of an adaptive PWM controller for a multi-phase LED driver are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Multi-channel LED driver ICs are used within TVs, monitors and laptop LCD backlight applications for driving a large number of LEDs with a single DC/DC converter. Almost all electrical power applied to an LED is consumed as thermal energy. This comprises about 75 to 85 percent of the electrical power applied to the LED. Only about 15 to 25 percent of the electrical power is converted to light energy. The remainder of the electrical power is consumed at a regulation FET and current sensor associated with the LED driver. This topology is a cheaper solution than one channel ICs with one DC/DC converter topology. However, this implementation includes serious drawbacks with respect to the power/thermal losses caused by linear regulation required to provide a constant LED forward current (IF) with different LED forward threshold voltages (VFT) for multiple LEDs. The main power loss within a conventional LED driver is caused by the linear regulation of different VFT's within each separate LED channel. LED costs should be higher to enable lower VFT variations or lower power loss at linear regulation. It is desirable to provide lower temperature and power losses within a driver IC even for those having higher VFT variations within the LED.

Conventional linear regulation is good for sustaining constant LED forward current in varied LED forward voltages using one boost multi-channel topology. However, this linear regulation topology has critical limitations because of inherent thermal dissipation proportional to regulation voltage in the number of channels. The disclosed implementation removes linear regulation which is the main reason the power loss and higher case temperatures within the circuitry. The described system can easily be implemented with a simple current ratio detection and gamma correction logic application without any side effects on the performance or significant cost additions to the circuitry.

Referring now to FIG. 1, there is illustrated a conventional multi-channel LED driver 102. The input voltage $V_{IN}$ is applied to the LED driver at node 104 of a voltage regulator. An inductor 106 is connected between node 104 and node 108. A diode 110 has its anode connected to node 108 and its cathode connected to node 112. The output voltage node $V_{OUT}$ of the voltage regulator is connected with each of the LED strings 114. A capacitor 116 is connected between node 112 and ground. An N-channel transistor has its drain/source path connected between node 108 and ground. The gate of transistor 118 is controlled by a boost controller circuit 120 responsive to control signals received from head room sensing and control logic 122.

Each LED string 114 is connected to the output voltage node 112 at the top of the LED string 114. The bottom end of each LED string 114 is separately connected to the nodes VCH1 to VCHN respectively. The headroom sensing and control logic 122 monitors the voltage at the VCH1 node 124 and VCHN node 126 and at all nodes at the base of the LED strings 114. The N-channel transistor 128 has its drain/source path connected between node 124 and node 130. A resistor 125 is connected between the gate of transistor 128 and ground. A resistor 132 is connected between node 130 and ground. A comparator 134 is connected to receive a reference voltage $V_{REF}$ and is also connected to monitor the voltage at node 130. The output of the comparator 134 is connected to a switch 136 that is controlled responsive to control signals received from dimming control logic 138. The dimming control logic 138 is also connected to receive dimming data via input 140. Connected with node 146 is similar logic connected to node 124 which also receives control signals from the dimming control logic 138.

Figure 2:
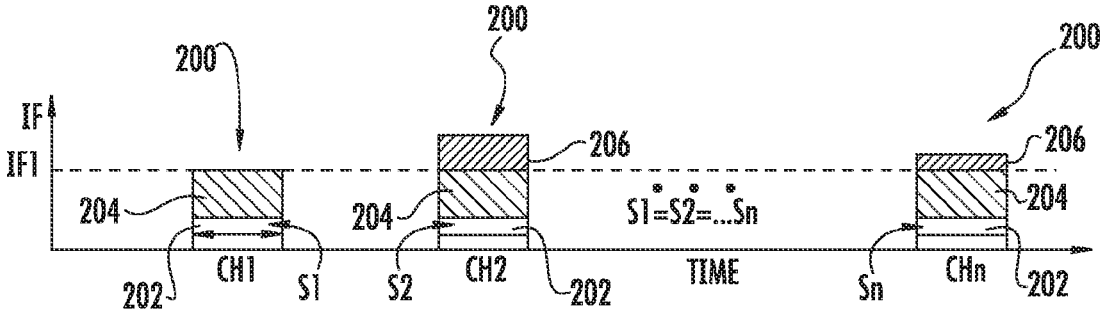
FIG. 2 PRIOR ART
FIG. 2 illustrates the power losses of a conventional LED driver.

Referring now also to FIG. 2, there is illustrated the power losses associated with the conventional LED driver illustrated with respect to FIG. 1. FIG. 2 shows how the conventional LED driver of FIG. 1 consumes the power. The figure also shows graphically that the portion of the light energy is determined by the peak current and ON time. The X axis represents time while the Y axis represents the LED forward current for each of the LED string 114. Each of the blocks 200 represent the total power losses associated with each channel of the LED driver. The light intensity of the LEDs is represented by the area 202 illustrated at the bottom of each of the blocks 200 associated with the channels. The majority of the electrical power applied to the LED string 114 is consumed as thermal energy represented by the area 204. This comprises about 75 to 85 percent of the electrical power provided to the LED string. Thus, only 15 to 25 percent of the electrical power is converted to light energy represented by the area 202. The remainder of the electrical power is consumed by the regulation of the switching transistor 118 and the current sensing of the headroom sensing and control logic 122. The power/thermal losses caused by the circuit of FIG. 1 due to the use of linear regulation to provide a constant LED forward current through multiple LED strings 114 having different LED forward threshold voltages has a significant drawback. The main power loss of a conventional LED driver is caused by the linear regulation of the circuit due to different VFTs across the LED strings 114 in each channel. This power loss is illustrated by the area 206.

Figure 3:
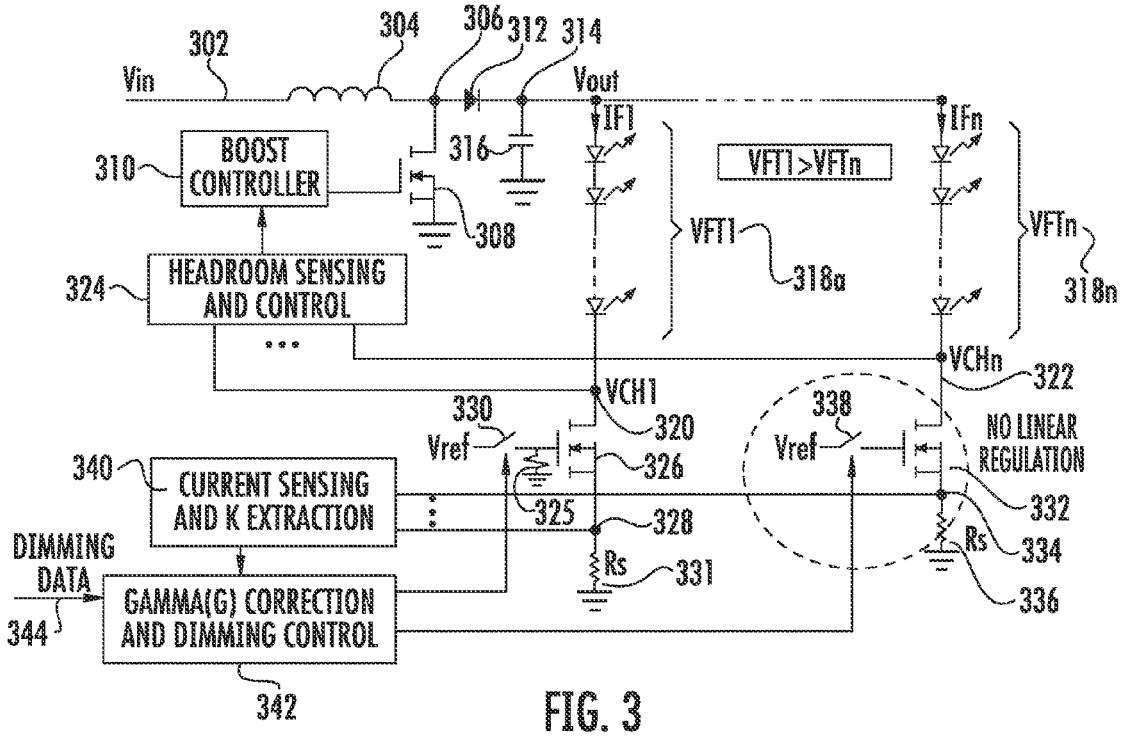
FIG. 3 illustrates a multi-channel LED driver according to the present disclosure.

Referring now to FIG. 3, there is illustrated a multi-channel LED driver having improved performance over the driver illustrated with respect to FIG. 1. The multi-channel LED driver of FIG. 3 provides lower power losses within the driver without requiring linear regulation. The described driver consumes power only within the FET switch 308 and the current sensing resistors (331, 336) associated with each of the LED strings and does not require power losses for linear regulation. Thus, the LED driver can improve power losses and IC temperature significantly by the removal of the linear regulation without an impact on the performance or a significant increase in cost.

The input voltage $V_{IN}$ is applied at node 302 to an input of a voltage regulator. An inductor 304 is connected between node 302 and node 306. An N-channel transistor 308 has its drain/source path connected between node 306 and ground. The gate of transistor 308 is connected to receive control signals from a boost controller 310. A diode 312 has its anode connected to gate node 306 and its cathode connected to node 314, the output voltage node $V_{OUT}$ of the voltage regulator. The output voltage node $V_{OUT}$ is connected with each of the led strings 318. Each of the strings 318*a* through 318*n* is associated with a separate channel of the multi-channel LED driver. A capacitor 316 is connected between node 314 and ground.

The output voltage is provided at node 314 to each channel of the series connected LED strings 318. Each of the series connected LED strings 318 are connected at node 314 at the top end of the string and at a node 320 or 322 at the bottom of the string. It will be realized that node 320 is associated with channel 1 of the multi-channel LED driver and node 322 is associated with channel N of the LED multi-channel driver. Multiple channels would be between channel 1 and channel N and additional nodes and LED strings 318 would be associated with each channel. Headroom sensing and control logic 324 is connected to nodes 320 and 322 and to each node at the bottom of each LED string 318 on each channel. The headroom sensing and control logic 324 provides control signals to the boost controller 310. Each node at the bottom of an LED string 318 includes an N-channel transistor 326 having its drain/source path connected between node 320 and node 328. A resistor 325 is connected between the gate of transistor 326 and ground. A resistor 331 is connected between node 328 and ground. The gate of transistor 326 is connected to a reference voltage $V_{REF}$ through a switch 330. The operation of the switch 330 is controlled by gamma G correction and dimming control logic 342 to increase and decrease the light intensity of the LED string 318. The gamma correction and dimming control logic 342 receives dimming data via input 344. Current sensing and K extraction logic 340 monitors the current at node 328 and performs the K extraction process as will be more fully described herein below.

A similar circuit is associated with node 322. An N-channel transistor 332 has its drain/source path connected between node 322 and node 334. A resistor 336 is connected between node 334 and ground. The gate of transistor 332 is connected to the reference voltage $V_{REF}$ through a switch 338. The switch 338 is under the control of the gamma correction and dimming control logic 342 to increase and decrease the light intensity of the LED string 318. The current sensing and K extraction logic 340 also monitors the current through node 334. The circuitry would be repeated on each channel of the multi-channel LED driver and connected to the bottom of each of the LED strings 318.

Figure 4:
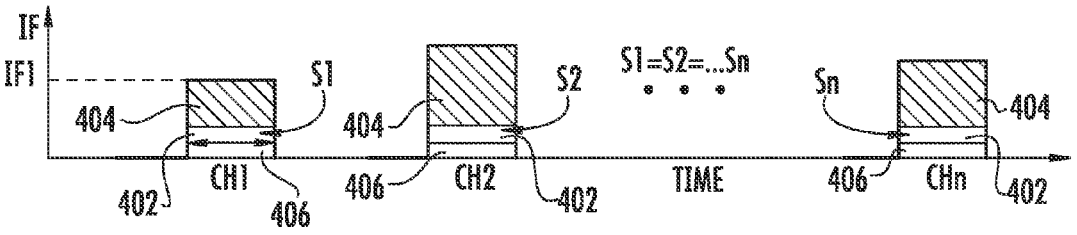
FIG. 4 illustrates the power losses of the LED driver of FIG. 3.

Referring now also to FIG. 4, there is illustrated the power losses associated with the LED driver illustrated with respect to FIG. 3. FIG. 4 shows how the LED driver of FIG. 3 consumes the power. The figure also shows graphically that the portion of the light energy is determined by the peak current and ON time. The X axis represents time while the Y axis represents the LED forward current for each of the LED string 318. Each of the blocks represent the total power losses associated with each channel of the LED driver. The light intensity of the LEDs is represented by the area 402 illustrated at the bottom of each of the blocks associated with the channels. The majority of the electrical power applied to the LED string 318 is consumed as thermal energy represented by the area 404. This comprises about 75 to 85 percent of the electrical power provided to the LED string. Thus, only 15 to 25 percent of the electrical power is converted to light energy represented by the area 402. The remainder of the electrical power is consumed by the regulation of the switching transistor 308 and the current sensing of the headroom sensing and control logic 324. The power/thermal losses caused by the circuit of FIG. 3 due to the use of linear regulation to provide a constant LED forward current through multiple LED strings 318 having different LED forward threshold voltages has a significant drawback. The main power loss of a conventional LED driver is caused by the linear regulation of the circuit due to different VFTs across the LED strings 318 in each channel. This power loss is illustrated by the area 406.

The light intensity (which is proportional with the average current through the LED) is: IFn*(Tn/T)=IFn*Dn, where Dn is the duty cycle of the n-th LED string, Tn is the on-time of the n-th LED string within each TP period, IFn is the current through the n-th LED string and TP is the period of the operation of all the LED. The current sensing and K ratio extraction logic 340 senses the LED forward current $I_F$ through each channel of the multichannel LED driver and performs an extraction of the current ratio for the multi-channel LED driver. For the same light intensity within each of the LED strings 318, the duty cycle of each channel of the multi-channel LED driver can be extracted from the current ratio between the minimum forward current and the compared channel current. This is more fully illustrated in FIG. 5. If the current ratio $K_2=I_{F2}/I_{F1}$ and $I_{F1}$ is the minimum current among all of the channels of the multi-channel LED driver, the light intensity S2 will be equal to $T_2 \times I_{F2}$ and can be expressed as $(T_1/K_2)\times(I_{F1}\times K_2)$, where Tn=T1/Kn. A more detailed procedure for the extraction of K by the current sensing and K extraction logic 340 is described herein below. All duty cycles will be adaptively selected by $T_1$ with extracted $K_1, K_2, \ldots K_N$.

If electrical power is fully converted to the light energy, the area S will be the light intensity, as follows:

$$S1=S2=S3 \ldots =Sn. \text{ Since } S=T*IF, \text{ then:}$$

$$T1*IF1=T2*IF2=T3*IF3 \ldots =Tn*IFn$$

If the measured current IF1 has a minimum value in all channels then:

$$IF1=K1*IF1(K1=1), IF2=K2*IF1, IF3=K3*IF1 \ldots IFn=Kn*IF1.$$

K of each channel will be extracted by the current sensing and K ratio extraction logic as:

$$K1=1, K2=IF2/IF1, K3=IF3/IF1 \ldots Kn=IFn/IF1$$

T of each channel expressed by K, and thus:

$$T1*IF1=T2(K2*IF1)=T3*(K3*IF1)=\ldots Tn*(Kn*IF1).$$

Therefore, $T2=T1/k2, T3=T1/K3 \ldots Tn=T1/Kn$.

Figure 5:
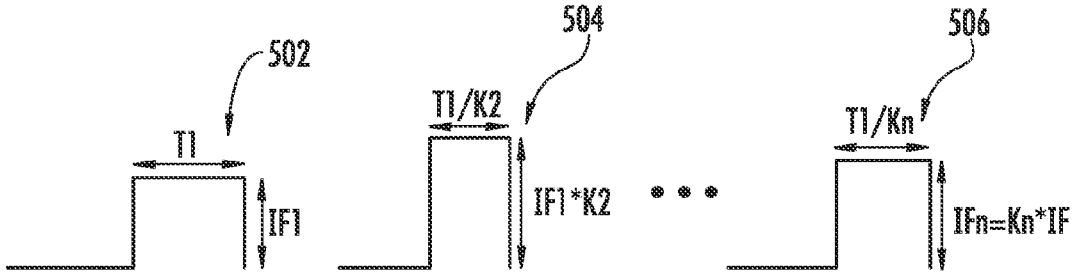
FIG. 5 illustrates the timing for a duty cycle and LED forward current ratio K in each channel at a same light intensity.

FIG. 5 illustrates the timing for the duty cycle and LED forward current ratio K in each channel when each channel is at the same light intensity. The X axis represents the time while the Y axis represents the LED forward current ($I_F$) magnitude. In channel 1, indicated generally at 502, the transistor is turned on for time T to generate the LED forward current $I_F$ as indicated. Similarly, in a second channel indicated generally at 504 the switching transistor is on for time $T_1$ to generate an LED forward current of $I_{F1}$. In the second channel indicated generally at 504, the on time of the switching transistor is determined according to the on time of the previous transistor divided by the current ratio $K_2$ extracted by the logic 340. The LED forward current in this channel will be the LED forward current of the previous channel times the current ratio K value. Similarly, in channel N indicated generally at 506 the on time for the switching transistor is the on time for the initial switching transistor $T_1$ divided by the current ratio $K_N$ and the LED forward current is represented by the value of the initial LED forward current times the current ratio $K_N$.

The gamma correction and dimming control logic 342 controls operation of the switch connected between the reference voltage $V_{REF}$ and the gate of the N-channel transistors (326, 332) connected to the bottom of each LED string 318. This controls the light intensity of the LED string 318. The input dimming data provided to the gamma correction and dimming control logic 342 at input 344 will determine the LED duty cycle. The gamma curve (G) shows the relationship between the input gray level and the output LED duty cycle. The conventional gamma curve is always fixed with a 100% maximum duty cycle (DMAX) versus a maximum gray level (GMAX). Within the LED driver IC of FIG. 3, DMAX of each channel will be adaptively selected by DMAX 1 with extracted K values $K_1, K_2, \ldots K_N$ as shown below.

If maximum grey step (GMAX) is fixed, G curve will be determined by maximum duty cycle (DMAX) and maximum ON time (T_MAX) as follows:

$$DMAX=T_MAX/TP;$$

$$T2_MAX=T1+MAX/K2, T3_MAX=T1_MMAX/K3 \ldots Tn_MAX=T1_MAX/Kn$$

Thus, $$DMAX1=(T1_MAX/K1)/TP$$

$$DMAX2=(T1_MAX/K2)/TP$$

$$DMAX3=(T1_MAX/K3)/TP$$

$$DMAXn=(T1_MAX/Kn)/TP$$

The G curves of each channel will be extracted as:

At $G1, DMAX1=DMAX1/K1 (K1=1)$

At $G2, DMAX2=DMAX1/K2$

At $G3, DMAX3=DMAX3/K3$

At $Gn, DMAXn=DMAX1/Kn$

Figure 6:
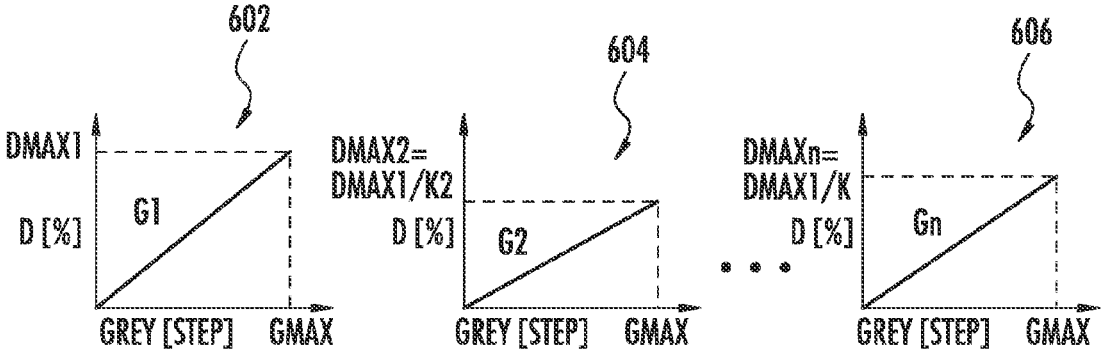
FIG. 6 illustrates the gamma curve and extraction based on the current ratio K in each channel of the LED driver.

FIG. 6 illustrates the gamma curve for channels of the multi-channel LED controller. The X axis represents the gray level out to the level GMAX on the first channel represented generally at 602, the second channel represented generally at 604 and the N-channel represented generally at 606. The Y axis represents the duty cycle with the 100% maximum duty cycle being represented by DMAX. Within the first channel at 602, the gray scale is at GMAX and the duty cycle is a DMAX1 representing a 100% duty cycle. In the second channel at 604, the gray scale is still at GMAX, but the duty cycle of DMAX2 is now represented by DMAX. Similarly, at channel N, the gray value is at GMAX and the DMAX value is equal to DMAX1/KN. The gamma curve $G_N$ is thus changed for each channel within the multi-channel LED controller based upon the changing value of DMAX.

The gamma correction and dimming control logic 342 also provides adaptive dimming control to the multi-channel LED driver. The boost controller 310 controls the duty cycle of the LEDs adaptively based upon the extracted current ratio and corrected gamma curves of each channel as described in the block diagram of FIG. 7. The current sensing and K extraction logic 340 senses the channel current IF1, IF2, . . . IFN and calculates the current ratio $K_1, K_2, \ldots K_N$ base for each channel based upon the minimum channel current. The extracted K values can be trimmed or calibrated internally by LED electro-optical and electro-thermal transfer efficiency.

Figure 7:
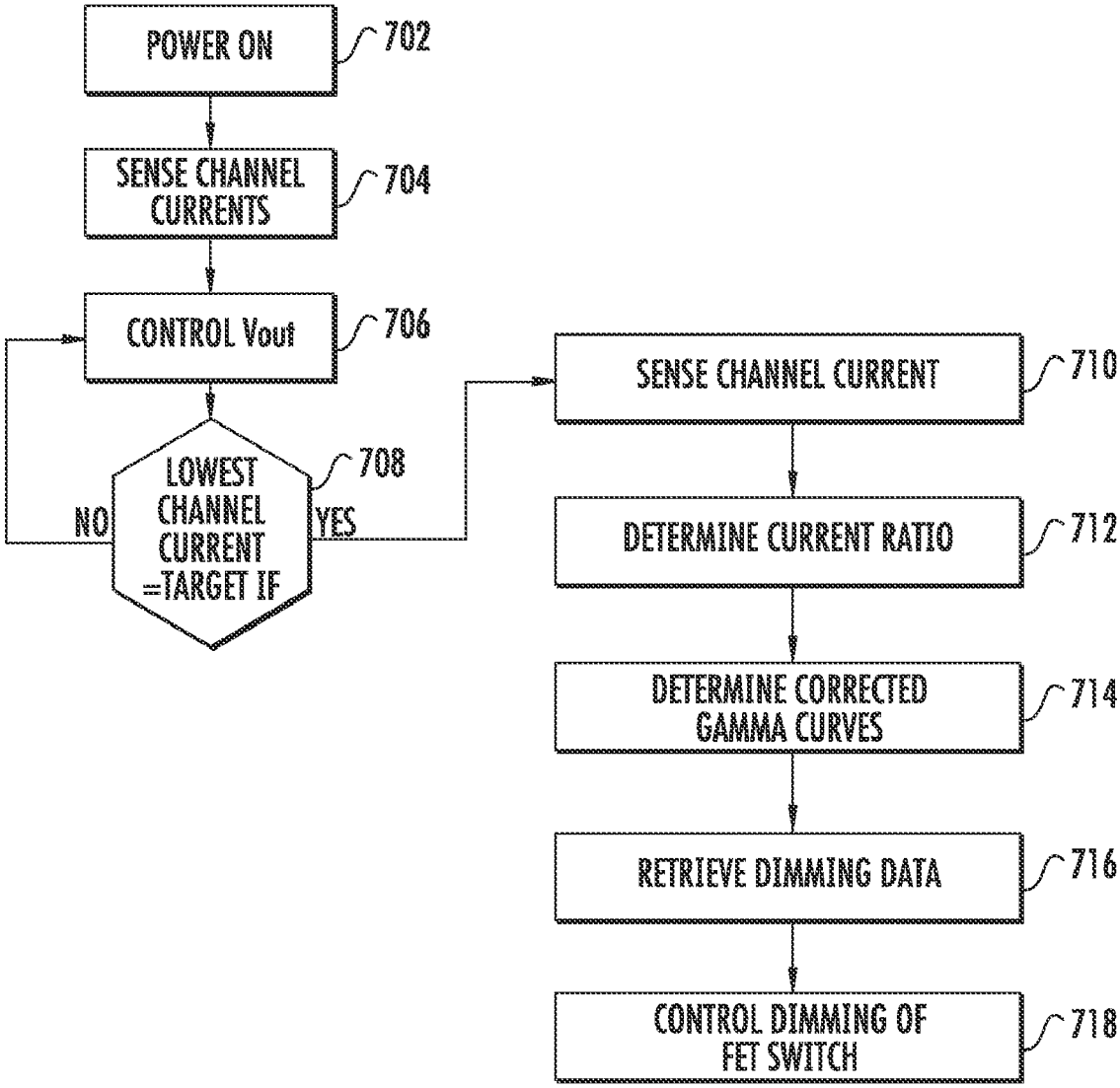
FIG. 7 is a flow diagram illustrating operation of the gamma correction and dimming control of the LED driver.

Referring now more particularly to FIG. 7, the operation of the gamma correction and dimming control logic 342 of the multi-channel LED driver is more fully described. The circuit is powered on at step 702. Next, all channel currents are sensed at step 704. The output voltage $V_{out}$ the boost converter is controlled via the PWM signal at step 706. Inquiry step 708 determines if the lowest channel current is equal to a target forward current IF. If not, control passes back to step 706 where $V_{out}$ is again adjusted by the PWM signal. When the lowest channel current equals the target forward current IF, the led forward currents IF through the LED strings 318 are sensed for each channel at step 710 by the current sensing and K extraction logic 340. Next, at step 712, the current sensing and K extraction logic 340 determines the current ratio for each channel. Using the determined current ratios, the gamma correction and dimming control logic 342 determines the gamma curves for each channel at step 714. Dimming data is received at step 716 by the gamma correction and dimming control logic 342. Using the determined gamma curves, the received dimming data is used to control the dimming by switching the FET switch at step 718. The minimum voltages at the bottom of each resistor string and the led forward current target values are provided by the headroom sensing and control logic 122. This information is used for controlling the operation of the boost controller 120 to provide the PWM control signal to the switching transistor 118 at step 706. The PWM frequency of all LED strings are same, thus the period TP will be Tn (On time)+Toff (OFF time=TP−Tn). All phases of duty cycle in each channel can be synchronous or asynchronous. The duty cycles of each channels can be refreshed sequentially (from CH1, CH2, . . . , CHn) right after current sense, or simultaneously after completion of all current sensing (K1, K2, . . . , Kn can be stored in the memory).

Channel matching will be performed sequentially string by string with FIG. 7. During the gamma correction for a certain string, the rest of channels can sustain previous gamma values in memory. In the power up (start up) stage, the maximum duty cycle (gamma) of all channels can have an initial values (Ex: 50%) before gamma correction. The ON time of all channels does not have to be synchronized. The light output is determined by averaged channel current. If the LED forward voltage variation in each string is ideally 0, the conventional driving could be good. But the forward voltage variation is over 5V (in case of 40 LEDs per string) in large sized LED backlight, so the conventional linear regulation driving can not be used for multi channel LED driver in this case. The purpose of this implementation is on the power loss reduction in the conventional driving due to the difference of forward voltages in each LED string. In this implementation, even the maximum duty cycle reduced (<100%) in FIG. 6 for the channel matching, the peak current can be increased with the extracted current ratio as shown in FIG. 5.

The power consumption level of the LED driver IC circuit of FIG. 3 can be calculated based upon the assumption that the LED driver IC includes eight channels, has a maximum VFT variation of 3 volts, a 100 millivolt led peak current and a minimum channel voltage (VCH) of 1 volt. The conventional LED driver would consume 2.9 watts of power (=1 CH×1 D×100 milliamp+7 CH×4 volts×100 milliamps) in a worst case scenario. However, the new LED driver implementation illustrated in FIG. 3 would utilize 0.8 watts of power maximum (=8 channel×1 volt×100 milliamps). The new driver IC will thus have a 72% improved power loss performance compared to conventional LED driver ICs.

It will be appreciated by those skilled in the art having the benefit of this disclosure that this adaptive PWM controller for multi-phase LED driver provides a driver using substantially less power than existing implementations. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A multi channel LED driver, comprising:

a plurality of LED strings, each associated with a separate channel;

a voltage regulator for generating on output voltage to the plurality of LED strings responsive to an input voltage and a PWM control signal;

a first control logic for generating the PWM control signal responsive to a voltage at a bottom of each of the plurality of LED strings;

a plurality of dimming circuitries each connected to one of the bottoms of the plurality of LED strings for controlling a light intensity in each of the plurality of LED strings responsive to dimming control signals, wherein the plurality of dimming circuitries further comprise:

a switching transistor connected to a bottom of one of the plurality of LED strings;

a switch for selectively connecting a reference voltage to a gate of the switching transistor responsive to the dimming control signals; and a second control logic for generating the dimming control signals responsive to forward currents monitored through each of the plurality of LED strings and dimming data, wherein the second control logic further comprises:

a third control logic connected to the switching transistor for sensing the forward currents through each of the plurality of LED strings and generating a current ratio for each of the plurality of LED strings responsive to the sensed forward currents; and a fourth control logic for determining a gamma curve for each of the plurality of LED strings responsive to the generated current ratios and for generating the dimming control signals responsive to the determined gamma curves and the dimming data.

2. The multi channel LED driver of claim 1, wherein the second control logic further senses the forward current through each of the plurality of LED strings, extracts a current ratio for each of the plurality of LED strings, adaptively selects a maximum duty cycle for the plurality of dimming circuitries responsive to the extracted current ratios, determines a gamma curve for each of the plurality of LED strings responsive to the adaptively selected maximum duty cycle of the associated LED string and generates the dimming control signals responsive to the determined gamma curves and the dimming data.

3. The multi channel LED driver of claim 1, wherein the first control logic further comprises:

a headroom and sensing logic for logic for monitoring a voltage at the bottom of each of the plurality of LED strings and generating regulator control signals responsive thereto; and a regulator controller for generating the PWM control signal responsive to the regulator control signals.

4. The multi channel LED driver of claim 3, wherein dimming control signal closes the switch to increase an intensity of the LED string and opens the switch to decrease the intensity of the LED string.

5. A multi channel LED driver, comprising:

a plurality of LED strings, each associated with a separate channel;

a voltage regulator for generating on output voltage to the plurality of LED strings responsive to an input voltage and a PWM control signal;

a first control logic for generating the PWM control signal responsive to a voltage at a bottom of each of the plurality of LED strings;

a plurality of dimming circuitries each connected to one of the bottoms of the plurality of LED strings for controlling a light intensity in each of the plurality of LED strings responsive to dimming control signals, each of the plurality of dimming circuitries further comprising:

a switching transistor connected to a bottom of one of the plurality of LED strings;

a switch for selectively connecting a reference voltage to a gate of the switching transistor responsive to the dimming control signals;

a second control logic connected to the switching transistor for sensing forward currents through each of the plurality of LED strings and generating a current ratio for each of the plurality of LED strings responsive to the sensed forward currents; and a third control logic for determining a gamma curve for each of the plurality of LED strings responsive to the generated current ratios and for generating the dimming control signals responsive to the determined gamma curves and dimming data.

6. The multi channel LED driver of claim 5, wherein the third control logic further adaptively selects a maximum duty cycle for the plurality of dimming circuitries responsive to the extracted current ratios and determines a gamma curve for each of the plurality of LED strings responsive to the adaptively selected maximum duty cycle of the associated LED.

7. The multi channel LED driver of claim 5, wherein the first control logic further comprises:

headroom and sensing logic for logic for monitoring a voltage at the bottom of each of the plurality of LED strings and generating regulator control signals responsive thereto; and a regulator controller for generating the PWM control signal responsive to the regulator control signals.

8. The multi channel LED driver of claim 5, wherein dimming control signal closes the switch to increase an intensity of the LED string and opens the switch to decrease the intensity of the LED string.

9. A method for providing dimming control for a multi channel LED driver, comprising the steps of:

generating on output voltage to a plurality of LED strings responsive to an input voltage and a PWM control signal;

generating the PWM control signal responsive to a voltage at a bottom of each of the plurality of LED strings;

receiving dimming data;

controlling a light intensity in each of the plurality of LED strings responsive to dimming control signals;

generating the dimming control signals responsive to forward currents monitored through each of the plurality of LED strings and the dimming data; wherein the step of generating the dimming control signal further comprises the steps of:

sensing the forward currents through each of the plurality of LED strings;

generating a current ratio for each of the plurality of LED strings responsive to the sensed forward currents;

determining a gamma curve for each of the plurality of LED strings responsive to the generated current ratios; and generating the dimming control signals responsive to the determined gamma curves and the received dimming data.

10. The method of claim 9, wherein the step controlling further comprises the step of selectively connecting a reference voltage to a gate of a switching transistor connected to a bottom of the LED string of each of the plurality of LED strings responsive to the dimming control signals.

11. The method of claim 9, wherein the step of determining a gamma curve further comprises the steps of:

adaptively selecting a maximum duty cycle for the plurality of dimming circuitries responsive to the extracted current ratios; and determining the gamma curve for each of the plurality of LED strings responsive to the adaptively selected maximum duty cycle of the associated LED string.

12. The method of claim 9 further comprising the steps of:

monitoring a voltage at the bottom of each of the plurality of LED strings;

generating regulator control signals responsive to the monitored voltage; and generating the PWM control signal responsive to the regulator control signals.

13. A current dimming circuit for use with a multi channel LED driver, comprising:

a switching transistor connected to a bottom of one of a plurality of LED strings, each of the plurality of strings associated with a channel of the multi channel LED driver;

a switch for selectively connecting a reference voltage to a gate of the switching transistor responsive to dimming control signals;

a first control logic connected to the switching transistor for sensing the forward currents through each of the plurality of LED strings and generating a current ratio for each of the plurality of LED strings responsive to the sensed forward currents; and a second control logic for determining a gamma curve for each of the plurality of LED strings responsive to the generated current ratios and for generating the dimming control signals responsive to the determined gamma curves and dimming data.

14. The current dimming circuit LED driver of claim 13, wherein the second control logic further adaptively selects a maximum duty cycle for the plurality of dimming circuitries responsive to the extracted current ratios and determines a gamma curve for each of the plurality of LED strings responsive to the adaptively selected maximum duty cycle of the associated LED.

15. The current dimming circuit of claim 13, wherein dimming control signal closes the switch to increase an intensity of the LED string and opens the switch to decrease the intensity of the LED string.

* * * * *